United States Patent [19]

Gibson

[11] 4,197,528

[45] Apr. 8, 1980

[54] MOVEMENT-DETECTING PROCESSING CIRCUIT FOR AN ULTRASONIC DETECTION SYSTEM

[75] Inventor: William J. Gibson, Feltham, England

[73] Assignee: Eurolec Group Limited, Staines, England

[21] Appl. No.: 897,285

[22] Filed: Apr. 17, 1978

[30] Foreign Application Priority Data

Apr. 22, 1977 [GB] United Kingdom ..... 16879/77

[51] Int. Cl.[2] ..... G08B 13/18

[52] U.S. Cl. ..... 367/93; 340/528; 343/5 SM

[58] Field of Search ..... 340/560, 558, 554, 528; 343/5 SM, 5 PD

[56] References Cited

U.S. PATENT DOCUMENTS

| | | | |
|---|---|---|---|
| 3,331,065 | 7/1967 | McDonald | 340/554 |
| 3,594,768 | 7/1971 | Harris et al. | 340/528 |
| 3,659,290 | 4/1972 | Bourque | 343/5 SM |
| 3,846,778 | 11/1974 | Galvin et al. | 340/554 |
| 3,967,283 | 6/1976 | Clark et al. | 340/554 |
| 4,028,690 | 6/1977 | Buckley et al. | 343/5 PD |
| 4,054,871 | 10/1977 | Terrell et al. | 340/554 |

FOREIGN PATENT DOCUMENTS

| | | | |
|---|---|---|---|
| 581448 | 8/1959 | Canada | 343/5 SM |

*Primary Examiner*—Glen R. Swann, III

*Attorney, Agent, or Firm*—Brisebois & Kruger

[57] ABSTRACT

A transmitter/receiver supplies echo signals to an amplifying circuit incorporating an attenuator, whereby the circuit has a variable amplification factor tending to compensate for reducing magnitude of the amplitudes of the echo signals with distance of detected objects from the transmitter/receiver. The area of detection is divided into alternate active and inactive zones radiating outwardly from the transmitter/receiver, the amplified echo signals emanating from objects in the active zones during a given operating cycle are integrated and the total output is compared with the corresponding total for the preceding cycle.

9 Claims, 4 Drawing Figures

MOVEMENT-DETECTING PROCESSING CIRCUIT FOR AN ULTRASONIC DETECTION SYSTEM

BACKGROUND TO THE INVENTION

A variety of detection methods have been proposed to detect the movement of an object within the range of an ultrasonic detection system, but one main practical problem is to provide for relative immunity from ultrasonic interference giving rise to false alarms. Such interference may be caused for example by the changing density of air produced by fan heaters, and this in turn results in a variation of the echo pattern of fixed objects within the range of the detection system. Another source of interference is ultrasonic noise produced for example by a metallic object, such as a spanner, which has been dropped, or by a bell ringing. This practical problem at least partly arises due to difficulties in setting the sensitivity of the detection system.

OBJECT OF THE INVENTION

It is an object of the present invention to provide an ultrasonic detection system which is less sensitive to interference but which nevertheless retains high sensitivity with respect to moving intruders in the detection area.

BRIEF SUMMARY OF THE INVENTION

According to one aspect of the present invention, there is provided an ultrasonic detection system in which radiated ultrasonic signals are reflected by objects in the area of detection to be converted by a transducer into electrical echo signals, wherein the echo signals are fed to an amplifying means having an amplification characteristic which is variable with time in such a manner that echo signals relating to objects closer to the ultrasonic signal source are amplified less than echo signals relating to objects further from said source.

FURTHER FEATURES OF THE INVENTION

Preferably, the amplifying means comprises an amplifier and a variable current source, the amplifier having an input fed with the echo signals and with the output of a variable current source. Conveniently, over a given response period, the amplification factor of the amplifying means increases approximately exponentially with time. In this case, the variable current source preferably comprises a capacitor-resistor network which, over the given response period, causes a diode connected to the amplifier input to conduct an exponentially decaying current.

According to another aspect of the present invention, in a method of ultrasonic detection of movement, the area of detection is divided into alternate active and inactive zones radiating outwardly from a source of ultrasonic signals, whereby the echo of an object moving between said zones will give rise to appearing and disappearing patterns of signals at the output of a detector.

The system according to the invention has the advantage that the sensitivity may be appropriately chosen to avoid false alarms without impairing its ability to detect moving intruders.

DESCRIPTION OF EMBODIMENT

Figure 1:
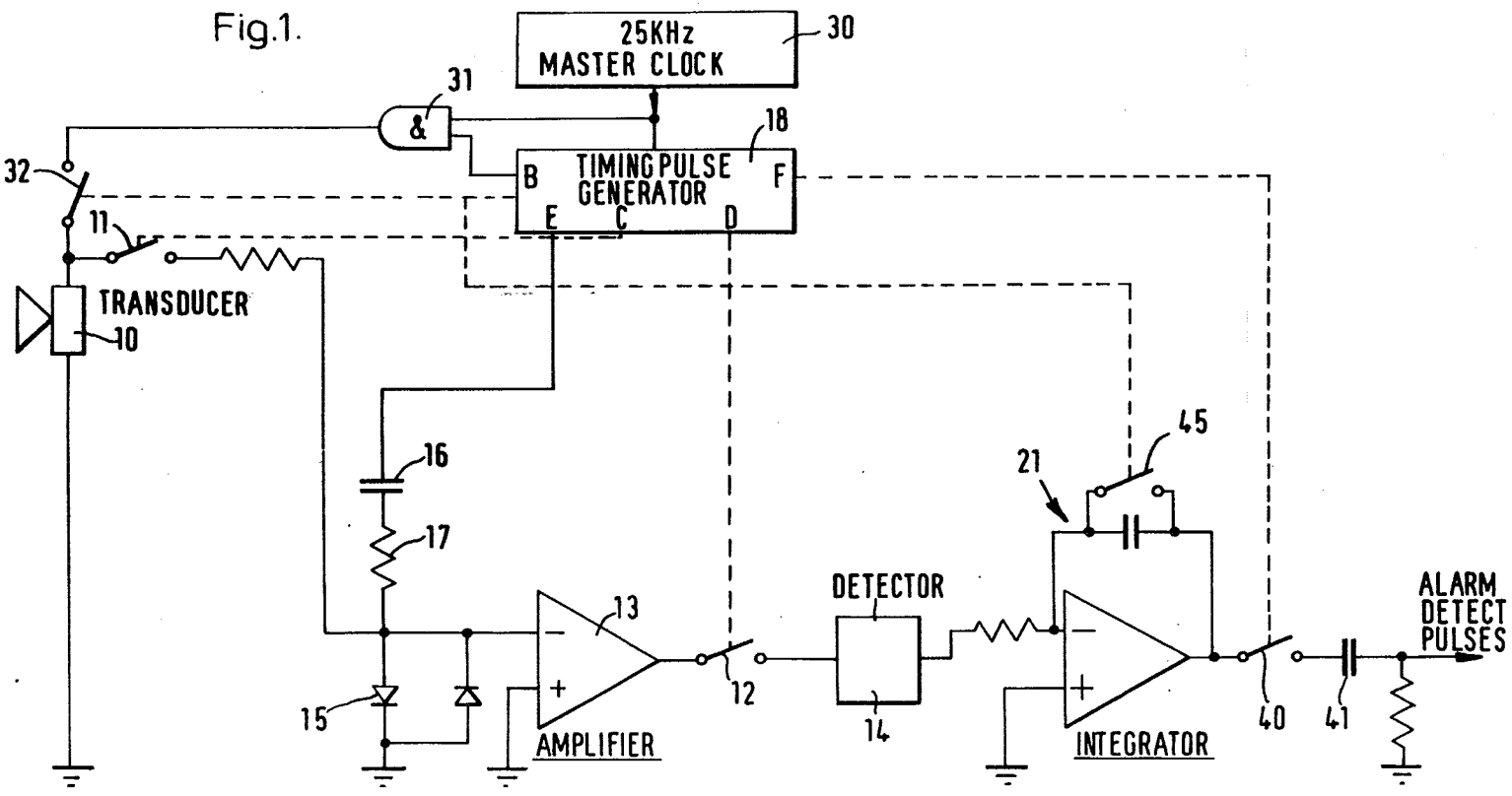
FIG. 1 is a block diagram showing the component parts of the detection system.

Referring to FIG. 1 of the drawings, an ultrasonic intruder detector system comprises a transmitter/-receiver constituted by an ultrasonic transducer 10 of the piezo-electric type arranged to transmit ultrasonic bursts of 1 to 2 msec. duration, at a frequency 25 kHz, at cyclic intervals of approximately 180 milliseconds. On completion of each transmission burst, an electronic switch 11 in the form of an analogue gate connects the transducer 10 to the input of a high gain amplifier 13. An oscilloscope, for example forming part of the detector generally indicated at 14, would display the output of this amplifier 13 as an echo envelope, in response to ultrasonic waves reflected from objects in the area of detection to be incident on the transducer 10.

As shown in FIG. 1, the transmission of ultrasonic signals is controlled by means of a master clock 30 and a timing pulse generator 18. The master clock 30 operates at 25 kHz and, in addition to supplying pulses of this frequency to the transducer 10 in order to activate it, also supplies pulses at 25 kHz frequency to the timing pulse generator 18, which contains various conventional frequency dividing and delay circuits for generating specific waveforms (waveforms B to F in FIG. 2) used for control purposes at various points in the detector system. One such waveform (waveform B) is supplied both to an AND gate 31 and to an electronic switch 32 in circuit with the master clock 30 and the transducer 10, whereby to produce the above-described ultrasonic bursts. In connection with FIG. 2, it is to be noted that the time scale for the master clock waveform is larger than the time scale employed to illustrate waveform B to F.

If the amplifier 13 were perfectly linear, the average height of the echo peaks seen at the detector 14 would fall off exponentially with time. Attenuating means are provided, however, in effect to attenuate echos from objects in the detection area closer to the transducer 10, that is to say early echoes, and they leave echoes from objects at a greater distance from the transducer 10, also referred to as late echoes, at or near their original amplitude. Thus, assuming a similar reflective index for these objects, late echoes emanating from more distant objects will appear at the detector 14 to be of similar magnitude to the early echoes from closer objects, so that the sensitivity of the system remains substantially constant with the distance of the object from the transducer 10.

Figure 3:
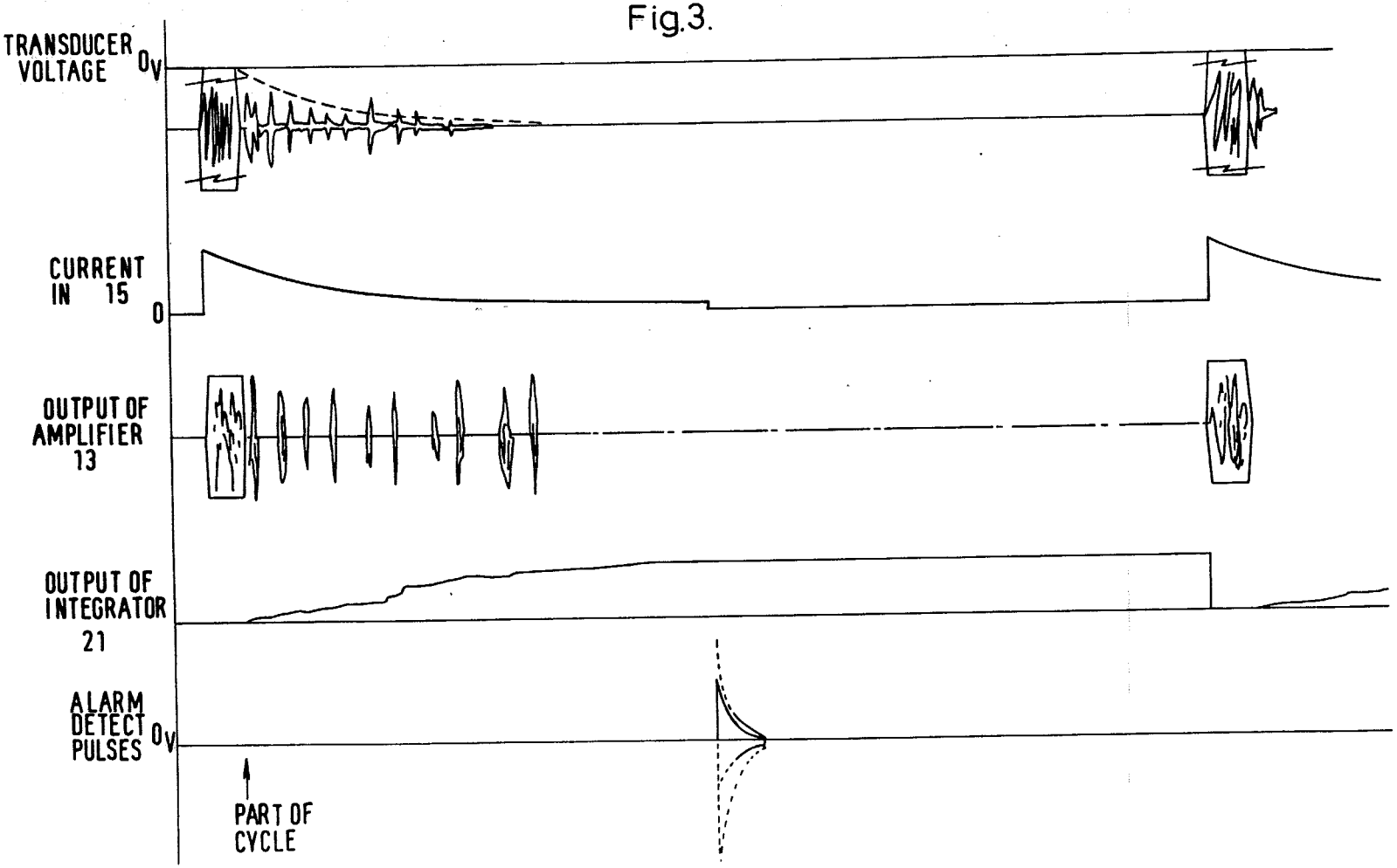
FIG. 3 is a representation of the operating waveforms at various points in the detection system shown in FIG. 1.

The attenuating means is in the form of a variable current source consisting of a capacitor 16, resistance 17 and diode 15, connected in series between the pulse generator 18 and ground. The junction between the resistor-capacitor network 16, 17 and the diode 15 is connected to the input to the amplifier 13. At the beginning of each cyclic interval of operation, the attenuating means is supplied with a square waveform of duration $T_1$ (say 15 to 20 msecs), which is referred to as the response period. This produces an exponentially reducing current in the diode 15, over the response period, as indicated by the second waveform in FIG. 3. This current is supplied to the amplifier input in effect to reduce the magnitude of early echo signals. Taken together, the amplifier 13 and the variable current source 16, 17, 15 constitute an amplifying means which, over the response period, has an amplification factor which increases approximately exponentially with time, thus generally compensating for the reducing magnitude of the echo peaks with distance, which on average reduce according to the factor $1/D^2$ or $1/T^2$, where D is the distance from the transducer 10 and T is time. This is illustrated by the first waveform in FIG. 3, showing the transducer voltage. In this waveform the magnitude of the echo peaks during transmission bursts is reduced for reasons of clarity.

Detection of movement is by means of an electronic switch in the form of an electronic analogue gate 12 and an electronic integrator 21. The analogue gate 12 is controlled by a 1 kHz square wave of unity duty cycle (waveform D in FIG. 2), which effectively divides the detection area in front of the ultrasonic transducer 10 into alternate active and inactive zones, with radii increasing by increments of about 6 inches. Hence a moving object will alternately pass through an active zone and then an inactive zone, and an echo, for example from an intruder moving within the detection area covered by the system, would give rise to an appearing and disappearing signal on the echo envelope of an oscilloscope forming part of the detector 14.

The analogue gate 12 is connected in series between the output of the amplifier 13 and the input of the integrator 21. The integrator 21 therefore provides an output which is the summation of the magnitude of echos received from objects in the active zones, i.e. echo signals received during the positive excursions of waveform D. At the termination of each operating cycle the voltage at the output of the integrator 21 is an indication of the total echo magnitude of all the active zones. Comparison of this voltage between successive cycles indicates if any object has moved into or out of the active zone.

Figure 2:
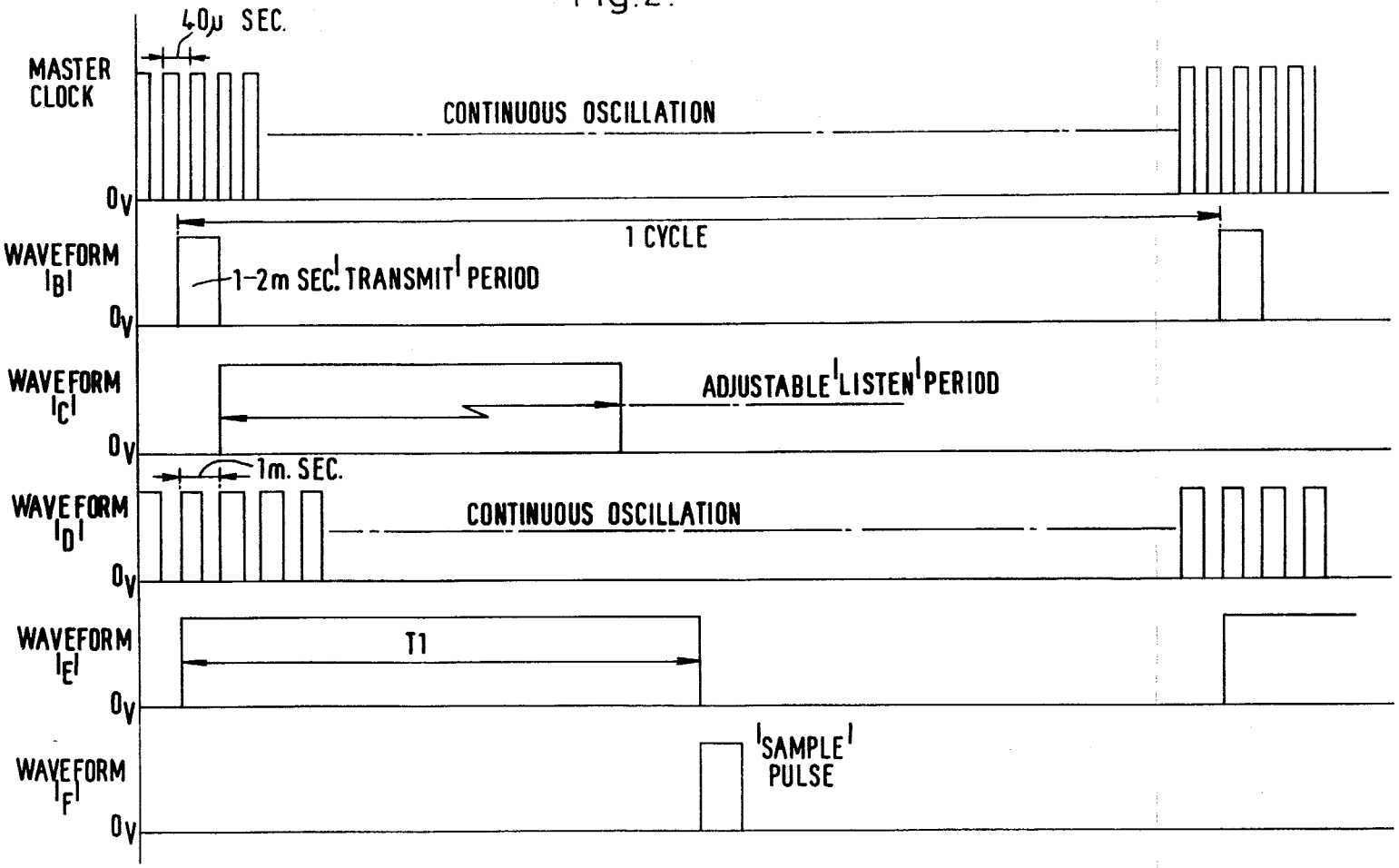
FIG. 2 is a representation of the timing pulses as they occur in various parts of the detection system shown in FIG. 1.

Comparison of the integrator outputs between successive cycles is effected by means of the sampling switch 40 and capacitor 41. The sampling switch 40 is closed once during each operating cycle, for example at the end of the period $T_1$ of waveform E, to store the integrator output on the capacitor 41. An alarm detect pulse is produced, on the output side of the capacitor 41, when the output of the integrator for a given cycle differs from the stored output from the preceding cycle. The difference between the two integrator outputs determines the polarity and magnitude of the alarm detect pulse. Waveform F in FIG. 2 shows an example of a sample pulse, which is supplied by the timing pulse generator 18. It is also to be noted that the pulse generator 18 supplies pulses in accordance with waveform B to a switch 45 connected across the integrator 21, in order to reset the integrator at the end of each operating cycle.

Referring back to FIG. 1, reference has been made to the electronic switch 11 which connects the transducer 10 with the amplifier 13. This switch is activated by a square waveform derived from the pulse generator 18 (waveform C in FIG. 2). When the detection system is installed, the duration of square waveform C is adjusted, within the duration of an operating cycle, to give a listening period appropriate to the range of detection required.

A facility may be provided for a loudspeaker to be activated initially by alarm detect output pulses when the equipment is switched on, thus providing clicks in response to movement near the detector. With this arrangement, the loudspeaker subsequently can be actuated automatically by a suitable oscillator upon receipt of an alarm detect output pulse after the expiration of a fixed period of time since the previous alarm detect output pulse.

Figure 4:
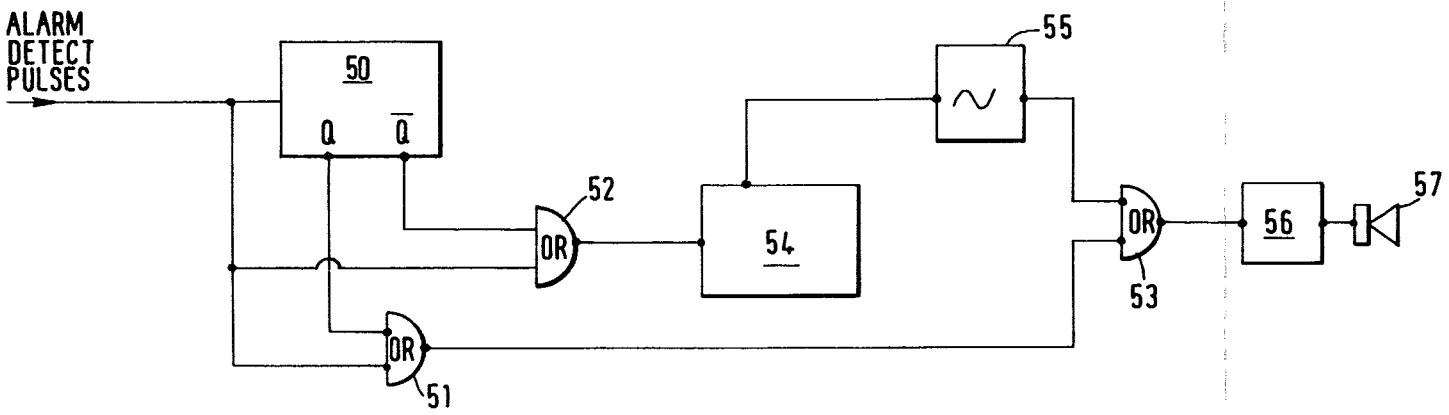
FIG. 4 is a block diagram of an alarm means fed with alarm detect pulses from the circuit of FIG. 1.

Thus, referring to FIG. 4, the alarm detect pulses are supplied to a resettable monostable 50, with complementary outputs Q and $\overline{Q}$. At the incidence of an alarm detect pulse the output Q is high and the output $\overline{Q}$ is low for a predetermined period of time, this being a characteristic of the monostable 50, which reverts to its monostable state automatically after said certain period of time. With the arrival of a new alarm detect pulse after expiration of the period, a new period is started. The intervening period thus provides a time delay, referred to as an exit delay, to enable an operator to leave the protected area without causing the alarm to operate.

During the initial exit delay the alarm detect pulses are steered via OR gates 51 and 53 directly to a power amplifier 56 preceding the loudspeaker 57, creating clicks which serves to test that the system is operating correctly. On completion of the exit delay, Q goes low and $\overline{Q}$ goes high. On the arrival of a further alarm detect pulse, this pulse is steered via OR gate 52 to a second monostable 54 whose function is to time an alarm by activation of an oscillator 55, the output of which is fed through gate 53 to the amplifier 56 and loudspeaker 57. The alarm continues until the monostable 54 resets after a predetermined time.

It wil be appreciated that, with the described arrangement, since the transmitted bursts of ultrasonic energy are very short in duration compared with the overall cycle time, power consumption is low. The minimum and maximum range of the system may be accurately preset without affecting its sensitivity to intruders. However, at the same time, the system is less prone than conventional systems to false operation due to interference.

I claim:

1. In an ultrasonic detection system in which radiated ultrasonic signals are reflected by objects in the area of detection to be converted by a receiving transducer into electrical echo signals, the combination of amplifying means comprising an amplifier and an attenuating means connected to an input of the amplifier, said attenuating means comprising a variable current source, an electronic switch connected between the receiving transducer and the amplifier input, a timing pulse generator comprising means, during an operating cycle, for generating a listening period control pulse, a response control pulse, and a series of relatively high frequency control pulses, circuit means connecting the timing pulse generator to an electronic switch to supply the listening period control pulse thereto for closing said switch for a listening period during which echo signals are fed to the amplifier, a circuit connecting the timing pulse generator to the attenuating means to supply the response control pulse thereto for causing the variable current source to supply a variable output to the amplifier during the listening period, whereby during the initial part of the listening period the amplification factor of the amplifying means is less than that in the later part of the period, a detecting means, an analogue gate connected between the output side of the amplifier and the detecting means, and circuit means connecting the timing pulse generator to the analogue gate to supply the high frequency control pulses thereto for opening and closing said gate a large plurality of times during a listening period, whereby the area of detection is effectively subdivided into alternating active and inactive zones corresponding to the alternating closed and open periods of the gate.

2. An ultrasonic detection system according to claim 1, wherein the variable current source comprises a capacitor-resistor network and a diode, the capacitor-resistor network being responsive to the response control pulse to cause the diode to conduct an exponentially decaying current and the voltage appearing across the diode being supplied to the amplifier input during the listening period.

3. An ultrasonic detection system according to claim 1, wherein the receiving transducer constitutes an ultrasonic signal transmitter/receiver controlled by a switch supplied at the beginning of an operating cycle with a transmission period control pulse from the timing pulse generator to cause said transmitter/receiver to transmit an ultrasonic signal burst, and the detecting means includes a reset electronic switch fed with said transmission period control pulse.

4. An ultrasonic detection system according to claim 1, wherein the detecting means comprises an integrator connected to receive the gated output of the amplifier, a storage capacitor, a sampling switch connected between the output side of the integrator and the storage capacitor, and circuit means connecting the sampling switch to the timing pulse generator to supply a sampling control pulse thereto after completion of the listening period, whereby a movement detect pulse is produced when the integrator output of the instant operating cycle differs from the integrator output of the preceding cycle which is stored by the storage capacitor.

5. An ultrasonic detection system according to claim 1, wherein the detecting means comprises means to produce movement detect pulses, the system including an alarm means fed with the movement detect pulses, said alarm means including a timing circuit responsive to the movement detect pulses to provide an initial delay period during which the alarm is not activated and an operator is enabled to leave the area of detection.

6. In an ultrasonic detection system in which radiated ultrasonic signals are reflected by objects in the area of detection to be converted by a receiving transducer into electrical echo signals, the combination of an amplifying means including an attenuating circuit, a timing pulse generator which during an operating cycle produces a response control pulse and a series of relatively high frequency control pulses, circuit means connecting the timing pulse generator to the amplifying means to supply the response control pulse thereto, the attenuating circuit being responsive to said response control pulse to continuously increase the overall amplification factor of the amplifying means during passage of a listening period during which echo signals are fed to the amplifying means, an integrator, an analogue gate connected between the output side of the amplifying means and the integrator, circuit means connecting the timing pulse generator to the analogue gate to supply the relatively high frequency control pulses thereto for opening and closing said gate a large plurality of times during the listening period, whereby the area of detection is effectively subdivided into alternating active and inactive zones corresponding to the alternating closed and open periods of the gate, and means whereby the integrated signal output appertaining to a given listening period is compared with that appertaining to the preceding listening period.

7. An ultrasonic detection system according to claim 6, wherein the attenuating circuit is a variable current source which comprises a capacitor-resistor network and a diode, the capacitor-resistor network being responsive to the response control pulse to cause the diode to conduct an exponentially decaying current and the voltage appearing across the diode is supplied to the amplifier input during the listening period.

8. An ultrasonic detection system according to claim 6, wherein the receiving transducer constitutes an ultrasonic signal transmitter/receiver controlled by a switch supplied at the beginning of an operating cycle with a transmission period control pulse from the timing pulse generator to cause said transmitter/receiver to transmit an ultrasonic signal burst, and the detecting means includes a reset switch fed with said transmission period control pulse.

9. An ultrasonic detection system in which radiated ultrasonic signals are reflected by objects in the area of detection to be converted into electrical echo signals, comprising a receiving transducer, an amplifying means, a timing pulse generator which produces a listening period control pulse and within said period a series of relatively high frequency control pulses, a detecting means, an analogue gate connected between the output side of the amplifier and the detecting means, a switch connected between the receiving transducer and the amplifying means, circuit means connecting the timing pulse generator to the analogue gate for supplying the relatively high frequency control pulses thereto and to the switch for supplying the listening period control pulse thereto, and a comparator means for comparing the output of the detecting means during a given listening period with that during the preceeding listening period.

* * * * *